United States Patent [19]

van Hattem et al.

[11] Patent Number: 4,599,252

[45] Date of Patent: Jul. 8, 1986

[54] METHOD OF MAKING A FIBROUS THERMALLY INSULATING LAYER OF COHERENT STRUCTURE, A LAYER MADE BY THIS METHOD, AND A THERMALLY INSULATING ELEMENT PROVIDED WITH SUCH A LAYER

[75] Inventors: Hendricus W. M. van Hattem, Vlissingen; Jules N. Isendam, Kesteren, both of Netherlands

[73] Assignee: Amgas B.V., Middelburg, Netherlands

[21] Appl. No.: 534,325

[22] Filed: Sep. 21, 1983

[30] Foreign Application Priority Data

Sep. 21, 1982 [NL] Netherlands ..... 8203647

[51] Int. Cl.[4] ..... B27N 5/02

[52] U.S. Cl. ..... 428/35; 156/62.2; 264/109; 264/121; 428/283; 428/325; 428/402; 428/920

[58] Field of Search ..... 428/283, 325, 402, 920, 428/921, 36, 35; 156/62.2; 138/149; 98/58; 220/445, 901; 264/109, 121

[56] References Cited

U.S. PATENT DOCUMENTS 4,104,170 8/1978 Nedza ..... 428/286

4,376,675 3/1983 Perrotta ..... 428/296

*Primary Examiner*—James J. Bell

*Attorney, Agent, or Firm*—Watson, Cole, Grindle & Watson

[57] ABSTRACT

In a method of making a fibrous thermally insulating layer of coherent structure, a quantity of fibers is treated with a binder, whereby prior to or during the treatment with the binder, fibers are formed into a quantity of particles each having a substantially rounded periphery and consisting of a number of short fibers and the particles treated with the binder are conveyed by means of a gas as conveying medium via an inlet piece 11, 13 to within a container 3, the particles being blocked by an outlet piece 8 for the container, the outlet piece 8 being formed with gas outlet apertures 10.

The particles are formed by vigorously agitating a number of flakes in a vessel, each flake consisting of arbitrarily arranged short fibers, and simultaneously applying pulsating forces to at least part of the volume of flakes, so that the flakes are converted into particles having a substantially rounded periphery and having a higher density than that of the flakes.

13 Claims, 3 Drawing Figures

METHOD OF MAKING A FIBROUS THERMALLY INSULATING LAYER OF COHERENT STRUCTURE, A LAYER MADE BY THIS METHOD, AND A THERMALLY INSULATING ELEMENT PROVIDED WITH SUCH A LAYER

BACKGROUND OF THE INVENTION

1. Field of the Invention

The present invention relates to a method of making a fibros thermally insulating layer of coherent structure, in which a quantity of fibers is treated with a binder.

2. The Prior Art

A method of this kind is disclosed in British Pat. No. 2 073 841. In this known method, a pipe perforated in the longitudinal direction is immersed in a very wet slurry consisting of a quantity of fibers and an aqueous binder. One end of the pipe is closed and a vacuum is formed inside the pipe by the application of suction at the other end, so that a very set fiberous layer is formed on the outer wall of the pipe. The pipe covered with this layer is then removed from the slurry and the layer is dried and hardened by heating. After removal from the pipe, a fibrous thermally insulating layer of coherent structure and relatively high hardness is obtained, which can be used independently as an inner pipe for a double-walled (Chimney) pipe element, the outer pipe of which consists of metal.

This known method has a number of drawbacks, to wit:

Since the slurry must be very wet in order to prevent cavities in the required layer, the thickness the layer can attain is very limited because the layer required to be formed on the outer wall of the pipe rapidly closes the perforations therein. The thickness and hence the insulation value of the resulting layer will therefore be low in the radial direction so that its use is limited. In this connection it should be noted that the insulation value of the layer both radially and axially is influenced negatively by the fact that the fibers are pressed closely together during the formation of the layer on the outer wall of the pipe so that the formation of closed air chambers of reasonable size necessary to thermal insulation is obstructed and there is a risk that the fibers will be pressed so close together that the layer can be regarded as consisting of a solid, so that it has low thermal insulation capacity.

Another drawback of the known method is that the resulting thermally insulating layer is hard and therefore liable to injury in respect of fracture. When a layer of this kind is used as a thermally insulating element, special steps must be taken to subject the layer to minimal mechanical loading. In practice, the fixing means required will result in the formation of cold bridges with very low heat resistance.

An additional drawback of the known method consists in that the layer must be formed in a vessel containing the wet fibrous slurry and with a perforate element of a specific shape for coating with the layer, so that the method is unsuitable for making extensive thermally insulating layers and for layers of any arbitrary shape.

Yet another disadvantage of the known method is that it is expensive to use because a considerable amount of heat has to be supplied for drying and hardening the layer.

SUMMARY OF THE INVENTION

It is a primary object of the present invention to obviate the disadvantages of the known method. According to the invention, prior to or during the treatment with the binder, fibers are formed into a quantity of particles, each having a substantially rounded periphery and consisting of a number of short fibers, and the particles treated with the binder are conveyed by means of a gas as conveying medium via an inlet piece to within a container, the particles being blocked by an outlet piece for the container, the outlet piece being formed with gas outlet apertures. The method is thus inexpensive to perform, e.g. when making a tubular, fibrous thermally insulating layer of coherent structure, the costs involved when using the method according to the invention are approximately one-third of that of the known method.

An additional advantage of the method according to the present invention is that the layer of considerable thickness can be obtained so that it has high thermal insulation capacity. This capacity is also increased by the fact that the resulting layer contains a large number of substantially closed air chambers. Depending on the quantity and type of fibers and/or the binder, it is possible to obtain a soft resilient to hard layer. When the layer is used in a thermally insulating element, a particular advantage of the soft layer is that it does not need to be fixed and/or retained by fixing means which cause cold bridges. More particularly, the layer can be formed directly in situ in a space intended for the purpose in an article for insulation, the size and shape of the article being of secondary importance.

To produce a substantially uniform density of the layer, it may be compacted in that area of the container which is situated substantially near the inlet piece. This can be done by reducing the distance between the pieces during or after filling of the container, e.g., by opening an outlet piece which is situated closer to the inlet piece, so that a very extensive layer with a substantially uniform density and of practically arbitrary shaped can be obtained with the available suction capacity.

To produce in particular an elongate layer, or if the layer has to be formed inside a space of a thermally insulating element comprising the container, it is advantageous, in order to produce a substantially uniform density, that after conveyance of the particles into the container, pressure is exerted on the particles mechanically at the inlet piece level in the direction of the outlet piece, so that density of the particles is increased at least in the area inside the container of the inlet piece.

In order that the container or the thermally insulating element may be readily filled completely and substantially uniformly with the particles, the inlet piece preferably contains a buffer chamber through which the particles are conveyed into the container until the buffer chamber is at least partially filled with particles, whereafter the mechanical pressure in the direction of the outlet piece is applied to the particles in the buffer chamber, so that at least some of the particles are pressed out of the buffer chamber into the container.

The binder used may consist of many kinds of material, e.g., resin or water glass, whereby, if necessary, its hardening may readily be effected by leading through the container a medium which hardens the binder, e.g., $CO_2$ gas at a suitable temperature.

A gas, e.g., air, at high temperature is preferably conveyed through the container in order to dry the layer formed in the container, if needed.

During drying of the layer there is the risk that evaporated solvents, e.g., water vapor, may condense on the cold inner wall of the container. Then a warm front slowly shifting in the direction of the outlet piece occurs during the condensation and re-evaporation, whereby the temperature at the outlet piece remains approximately constant as long as the warm front does not reach the outlet piece. The condensate formed in the area of the warm front must be re-evaporated, and hence heated, for its removal from the container which implies a significant energy loss. During drying, therefor, the container is preferably also heated in another manner. The energy loss is limited as a result and the drying rate is favorably affected. This heating can be carried out by radiant heat, e.g., from an infra-red radiation source, acting on the walls of the container itself.

The fibrous particles used in the method according to the invention have a substantially rounded periphery so that pressure can be applied to the particles mutually, so that the fibrous particles substantially cannot shift into each other; during conveyance of the particles no undesirable caking obstructing the conveyance occurs; there is sufficient insulating space between the particles in the resulting layer so that an undesirably high spread in the density and resilience of the layer is prevented. Shrinkage of the finished product is also prevented.

Fibrous particles of this kind having a rounded periphery can be formed by vigorosly agitating a volume of flakes in a vessel, each flake consisting of arbitrarily arranged short fibers, and simultaneously applying pulsating forces to at least part of the volume of flakes, so that the flakes are converted into particles having a substantially rounded periphery and having a higher density than that of the flakes. The flakes formed into particles will keep a suitable degree of gas permeability in these conditions.

Preferably, the flakes are treated, with a binder so that the rounded shape is obtained more readily and conveyance into the container is effected with little friction thus counteracting any uneven filling of the container. The particles in these conditions behave as granular particles, so that dosage and conveyance by a gas are simplified.

DESCRIPTION OF THE PREFERRED EMBODIMENTS

The particles used in forming a thermally insulating layer by the method according to the invention can be formed by introducing a quantity of fibrous flakes into the vessel of a mixer or agitator, whereafter the apparatus agitator element constructed in a specific form is rotated for a specific period and at a specific speed inside the vessel, in order to produce a specific density and shape of the particles required. The agitatior element rotating at a relatively high speed will exert pulsating forces on the flakes, so that particles are obtained which have a substantially rounded shape. The deformation of the flakes into the particles will proceed more favorably in these conditions if the flakes are treated with a liquid medium prior to or during the operation of the agitator. A medium of this kind can be formed by a binder which also reduces the mutual friction of the particles during the conveyance thereof into the container in which a thermally insulating layer is to be formed, so that conveyance will proceed more favorably and the container be filled with the particles more uniformly. After the container has been filled with the particles, the binder produces cohesion of the particles with one another and possibly of the fibers of each particle.

In a test rig for fibers consisting of aluminium silicate, 50 liters of flakes having a density of approximately 50 $kg/m^3$ were introduced into an agitator system, the vessel of which had a capacity of about 0.1 $m^3$ and the agitator element of which was formed by three flat agitator blades of substantially the same size disposed above each other along the axis of rotation thereof and having the dimensions 8 cm$\times$30 and making an angle of about 30° with respect to the axis of rotation.

The agitator element was then rotated at a speed of 200 rpm and 0.5 liter of water glass in a concentration of 40% by weight of water glass was sprayed into the vessel during rotation of the agitator element. After the system had been in operation for about 2 minutes, airy particles of a substantially rounded shape were obtained, the density of which was about 105 $kg/m^3$.

Figure 1:
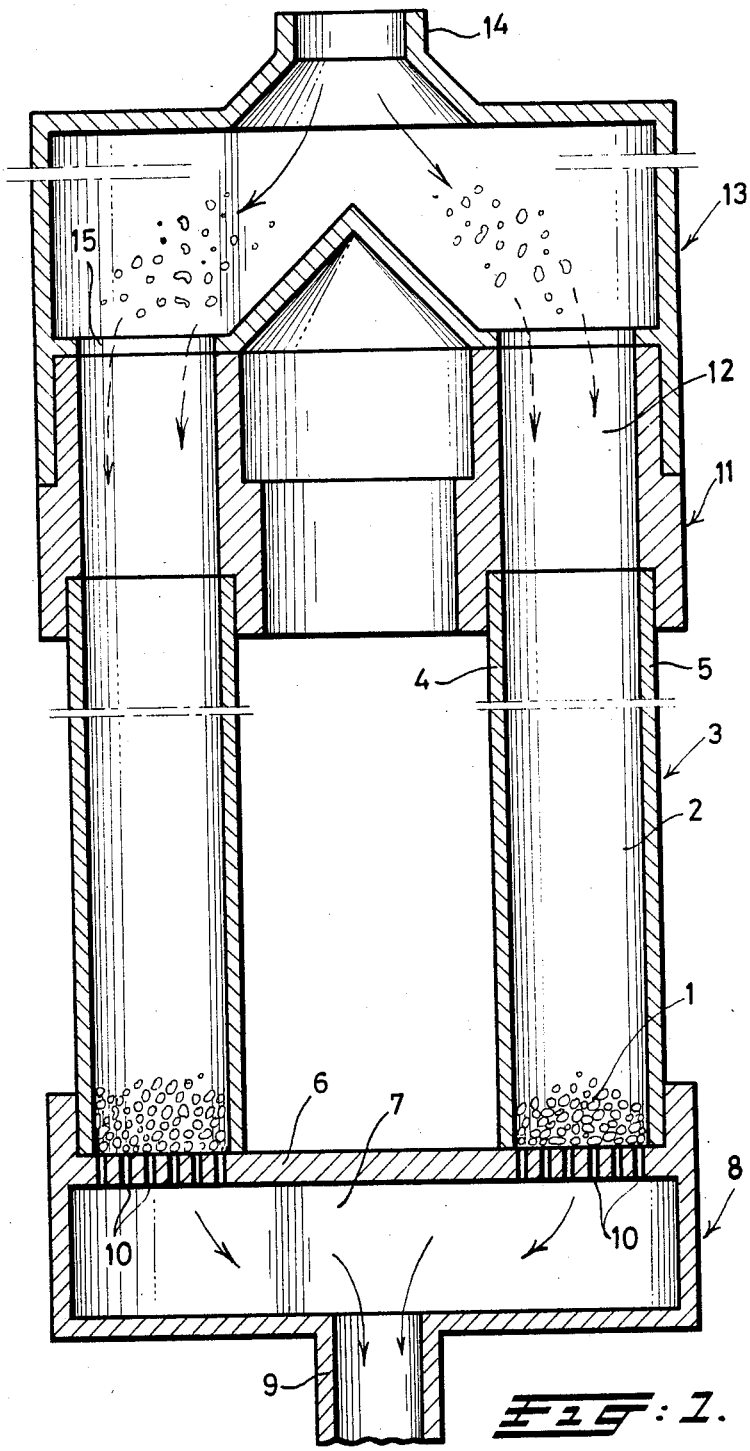
FIG. 1 illustrates a double-walled, tubular, thermally insulating element, in which a thermally insulating layer is being formed by means of the method according to the invention.

FIG. 1 shows schematically the installation for forming a thermally insulating layer 1 inside a space 2 in a double-walled tubular insulating element 3 comprising an inner pipe 4 and an outer pipe 5. The bottom of element 3 is closed by the top 6 of a chamber 7 of an outlet piece 8 having a coupling member 9 for connection to the suction inlet of a suction source (not shown). The top 6 of chamber 7 is provided with apertures 10 between the pipes 4 and 5, these apertures forming a barrier for the particles of the thermally insulating layer to be formed between the pipes 4 and 5.

On the top of the element 3 an inlet piece is disposed of which a coupling element 11 resting thereon, has a buffer chamber 12 which is concentric with respect to the pipes 4 and 5, and of which a feed element 13 having a coupling member 14 and an annular bottom outlet 15 rests on the coupling member 11. Although not illustrated, coupling member 14 may be connected, e.g. via a hose, to a vessel for sucking the particles therefrom through the feed element 13 and buffer chamber 12 into the space 2.

Figure 2:
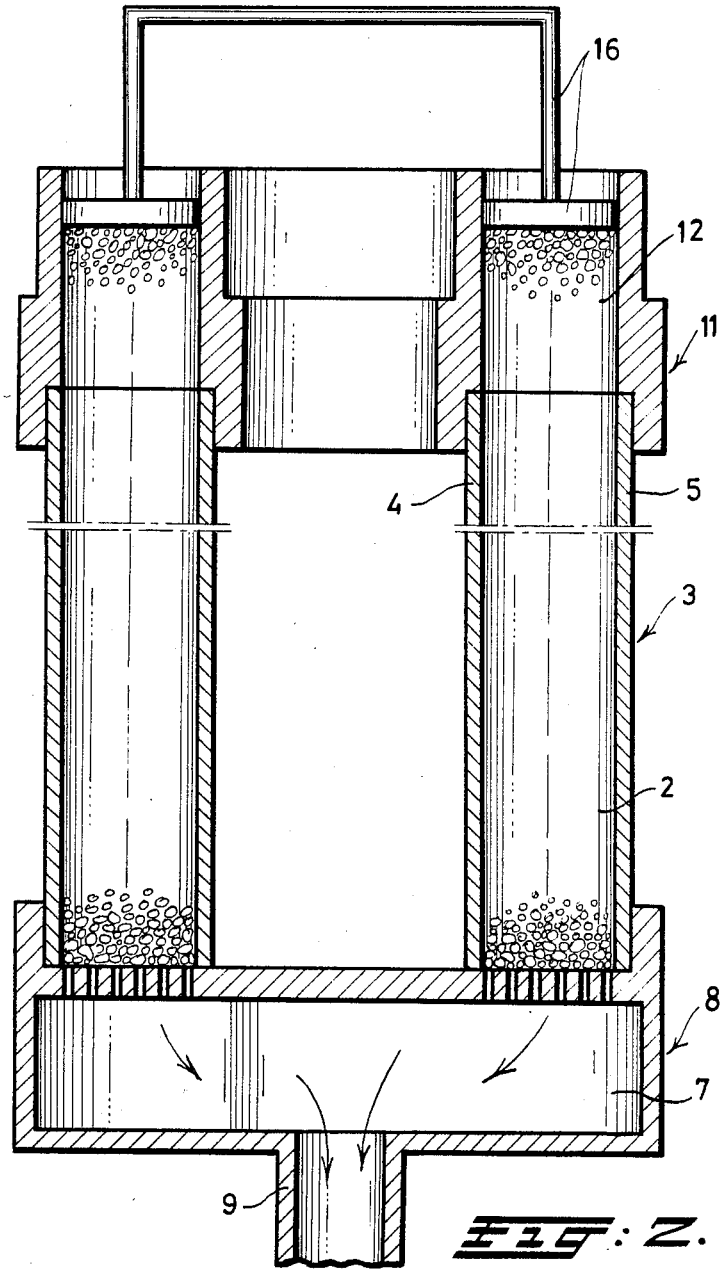
FIG. 2 is a subsequent step in the execution of the method according to FIG. 1.

While the particles are being sucked from the vessel, a layer consisting of these particles is gradually formed in the space 2 starting at the top 6 of the chamber 7 in the direction of the feed element 13. The density of the layer (or the particles) in the area of the bottom of the element 3 will be greater than in the area of the top thereof. To obtain a substantially uniform density of the layer inside the space 2, the conveyance of the particles is therefrom continued until at least part of the buffer chamber 12 is also filled with particles. The feed element 13 is then removed and, as shown in FIG. 2, a stamp element 16 is disposed on the particles in the buffer chamber 12, and is moved in the direction of the outlet piece 8, so that at least part of the particles is pressed out of the buffer chamber 12 into the space 2 and the spread of the density of the resulting layer in the space 2 is reduced.

In a test installation using particles of the above composition and density, the pipe element 3 had a length of 1 m and the space 2 had a passage area of 197 $dm^2$. Using the method described with reference to FIGS. 1 and 2 and a nominal under-pressure of about 13,000 Pascal in the chamber 7, a density of about 160 $kg/m^3$ was obtained at the bottom and top of the element 3 and about 140 $kg/m^3$ in the area near the middle of the element 3. When the step of pressing a quantity of particles out of the buffer chamber 12 into the space 2 was omitted, the density at the top of the element 3 was about 125 $kg/m^3$. This latter value gives a spread in the density of the layer such that the thermally insulting properties of the pipe element are inadequate and therefore certain testing offices in a number of countries would consider the same unacceptable in view of the lack of safety if the pipe element 3 were to be intended for use as a pipe element for conveying flue gases. In this connection it should be noted that increasing the under-pressure in the chamber of the outlet piece 8 is impossible, or else possible only to a limited degree, since the particles would as a result also become more intensely compacted in the region of the bottom of the pipe element 3, with the risk that the layer fromed in that area would be regarded as a solid, thus mkaing further conveyance of the particles difficult and also resulting in poor thermally insulating properties in that area.

After a layer has been formed in the space 2, $CO_2$ gas is fed, e.g., via elements 11 and 13, through the layer and the outlet piece 8, so that the binder formed by the water glass is hardened, so that the particles of the layer are interconnected and also a number of intersections of the fibers of each particle are connected. The water or other solvent present in the resulting layer is then removed by passing hot air through the layer. At the same time, preferaby at least the pipe 5 is also heated in some other way than by the hot air fed through space 2. The aditional heating of the pipe 5 is preferbly effected by radiant heat from an infra-red radiation source. This prevents aready evaporated water from condensing on part of the walls so the pipes 4 and 5 situated nearer to the outlet piece 8, re-evaporization of the condensate necessitating an extra energy supply and delaying the drying.

The resulting fibrous thermally insulting layer formed in the space 2 has a coherent structure. This layer may form an independent product if the pipes 4 and 5, which may if required comprise a number of parts, are removed from the layer. Alternatively, the layer together with the pipes 4 and 5 may form a unit which is capable of being commercially handled as a whole.

It should be noted that, depending upon the various dimensions, the particles supplied may be distributed over the annular space 2 unevenly and with an undesirable reduction of the speed thereof inside the feed element. This may cause clogging of the inlet of the feed element and/or an undesirable uneven filling of the space 2. Although not shown, these disadvantages can be obviated by constructing the feed element substantially in the form of a disk, provided a passage acting as an inlet and outlet in the disk above the space 2, and rotating the disk at a uniform speed about the axis of symmetry common with the pipes 4 and 5.

Figure 3:
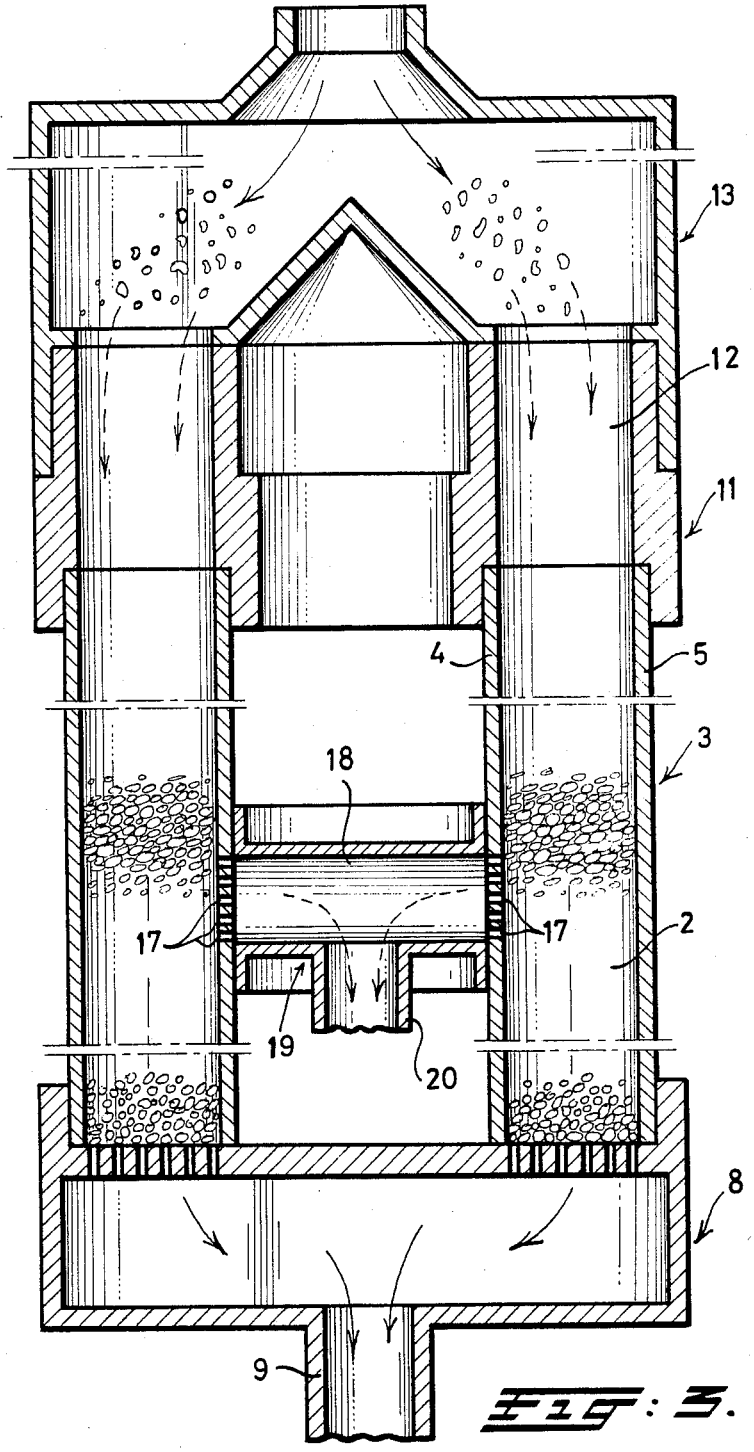
FIG. 3 is an installation for an alternative way of forming, more particularly, a separate tubular thermally insulating layer of coherent structure.

FIG. 3 shows an installation in which the spread of the density of the required layer can be reduced in a different way. This alternative may be applied together with or instead of the step using the stamp 16.

In the installation shown in FIG. 3, the inner pipe 4 has locally a number of passages 17 which lead into the space 2 of the element 3 on the one hand and into a chamber 18 of another outlet piece 19 on the other hand. As soon as the space 2 has been filled to a given height above the passages 17, the coupling member 20 of the outlet piece 19 is connected to the suction intake of a suction source. Generally, from that moment on, the connection between the coupling member 9 of the outlet piece 8 and another or the same suction source will be closed.

According to the installation shown in FIG. 3, a number of outlet pieces, such as 19, may be provided, while to obtain a small spread of the density of the layer radially, a number of the outlet pieces can be disposed concentrically around the outer pipe 5 locally provided with passages.

If required, the coupling element 11 and the stamp 16 may also be used in the manner already described.

Although with reference to the drawings installations have been described by which a tubular layer is obtained, the method according to the invention is also suitable for filling a thermally insulating layer in spaces in other articles and of different size and shape from the space 2. Articles of this kind may be provided with a number of inlet pieces and a number of outlet pieces to produce a substantially uniform density in every direction. The method according to the invention is also suitable, for example, for forming a layer of a coherent resilient structure in an insulating chamber of an oven.

Finally, the coherent structure of the insulating layer has on the one hand the advantages that the reuslting layer can be handled as a separate product while on the other hand, if it is provided in an insulating space of an article, it cannot collapse nor leak away through any aperture due to vibration and as a result of the flexibility that the layer can attain, it is not liable to damage and, after its installation, it can adapt to the shape of the insulation space.

What is claimed is:

1. A method of making a fibrous, thermally insulating layer of coherent structure using an apparatus which includes a container having an interior and two opposite ends which are open; an outlet element having a perforated portion which covers a first of said two open ends of said container; and an inlet element which covers a second of said two open ends of said container, said inlet element including a channel which communicates with the interior of said container, said method comprising the steps of providing a quantity fibrous particles which have rounded shapes, combining said fibrous particles with a binder so as to form a fiber particle-binder mixture, entraining said fiber particle-binder mixture in a gas stream, and conveying said gas stream with said fiber particle-binder mixture entrained therein through the channel in said inlet element and into the interior of said container such that the fiber particle-binder mixture will deposit on said perforated portion of said second element and accumulate in the interior of said container until said container is completely filled with said fiber particle-binder mixture from its first end to its second end, thus producing said coherent structure.

2. The method as defined in claim 1, including the step of applying pressure against the fiber particle-binder mixture at the second end of said container so as to compact said fiber particle-binder mixture in the interior of said container.

3. The method as defined in claim 1, wherein said pressure is applied by moving a plate element against the fiber particle-binder mixture.

4. The method as defined in claim 3, wherein said inlet element includes a coupling part in contact with the second end of said container and a removable feed part, wherein said step of conveying said gas stream with fiber particle-binder mixture entrained therein into the interior of said container is continued until the fiber particle-binder mixture fills at least a portion of said coupling part, and wherein the plate element is applied against the fiber particle-binder mixture located in said coupling part.

5. The method as defined in claim 1, including the step of passing a fluid medium through the fiber particle-binder mixture in the interior of said container, said fluid medium being capable of hardening said binder.

6. The method as defined in claim 1, including the step of passing a heated gas through the fiber particle-binder mixture in the interior of said container to dry said fibers.

7. The method as defined in claim 6, including the step of heating said container.

8. The method as defined in claim 1, wherein said step of providing said quantity of fibrous particles which have rounded shapes comprises vigorously agitating a volume of fibrous flakes in a vessel, each flake consisting of arbitrarily arranged short fibers, and simultaneously applying pulsating forces to at least part of the volume of flakes, so that the fibrous flakes are converted into fiber particles having a substantially rounded periphery and having a higher density than that of the fibrous flakes.

9. The method as defined in claim 1, wherein said short fibers consist of a ceramic material.

10. The method as defined in claim 9, wherein said short fibers consist of aluminum silicate.

11. The method as defined in claim 9, wherein said binder consists of water glass.

12. A fibrous, thermally insulating layer of coherent structure made by the method according to claim 1.

13. Particles each having a substantially rounded shape and consisting of a number of arbitrarily arranged short fibers, made by the method according to claim 8.

* * * * *